US011370009B2

(12) United States Patent
Yahagi et al.

(10) Patent No.: US 11,370,009 B2
(45) Date of Patent: Jun. 28, 2022

(54) METAL PLATE AND METHOD OF PRODUCING TUBULAR BODY

(71) Applicant: CANON KABUSHIKI KAISHA, Tokyo (JP)

(72) Inventors: Takashi Yahagi, Moriya (JP); Takahiro Kobayashi, Nagareyama (JP); Yoshiharu Irei, Fujisawa (JP); Shoji Sasaki, Yokohama (JP); Makoto Nishino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 286 days.

(21) Appl. No.: 16/697,764

(22) Filed: Nov. 27, 2019

(65) Prior Publication Data

US 2020/0094302 A1 Mar. 26, 2020

Related U.S. Application Data

(63) Continuation of application No. PCT/JP2018/020794, filed on May 30, 2018.

(30) Foreign Application Priority Data

May 31, 2017 (JP) ..... JP2017-108065

(51) Int. Cl.
*B21C 37/06* (2006.01)
*B21D 5/01* (2006.01)
(Continued)

(52) U.S. Cl.
CPC ..... *B21C 37/06* (2013.01); *B21D 5/01* (2013.01); *B21D 37/08* (2013.01); *B21D 39/03* (2013.01)

(58) Field of Classification Search
CPC ..... F16L 9/003; F16L 9/02; F16L 9/17; B21C 37/06; B21D 5/01; B21D 37/08; B21D 39/00
(Continued)

(56) References Cited

U.S. PATENT DOCUMENTS 578,801 A * 3/1897 Wilmot ..... B21D 39/037 138/156
1,016,584 A * 2/1912 Shepherd ..... B21D 39/037 138/165
(Continued)

FOREIGN PATENT DOCUMENTS

CN 87100239 A 12/1988
CN 1308999 A 8/2001
(Continued)

OTHER PUBLICATIONS

Chinese Office Action, dated Dec. 2, 2020, in corresponding Chinese Application No. 201880034612.9.
(Continued)

*Primary Examiner* — James F Hook
(74) *Attorney, Agent, or Firm* — Venable LLP

(57) ABSTRACT

A metal plate includes: a recessed portion provided at one end surface by cutting out the metal plate in a planar direction of the metal plate, the recessed portion having an engaging portion inside the recessed portion; and a protruding portion provided at a position on another end surface, the position corresponding to that of the recessed portion, the protruding portion protruding in the planar direction, the protruding portion being engaged with the engaging portion by applying a bending process such that the engaging portion is hooked by the protruding portion, wherein a length from a proximal end portion to a distal end portion of the protruding portion before the bending process is applied is equal to or less than a depth of the recessed portion at a
(Continued)

position of the recessed portion, the position facing an end surface of the proximal end portion of the protruding portion.

5 Claims, 17 Drawing Sheets

(51) Int. Cl.
*B21D 37/08* (2006.01)
*B21D 39/03* (2006.01)

(58) Field of Classification Search
USPC ..... 138/166, 167, 168, 169, 170
See application file for complete search history.

(56) References Cited

U.S. PATENT DOCUMENTS

| | | | | |
|---|---|---|---|---|
| 2,115,441 | A * | 4/1938 | Black | B21C 37/104 72/368 |
| 2,855,252 | A | 10/1958 | Budinger et al. | |
| 3,273,601 | A * | 9/1966 | Gain | B21D 51/10 138/166 |
| 4,490,422 | A * | 12/1984 | Pascher | B29C 61/10 138/156 |
| 6,391,414 | B1 * | 5/2002 | Hjertman | F16L 25/0018 138/120 |
| 10,031,468 | B2 | 7/2018 | Endo et al. | |
| 2001/0020491 | A1 | 9/2001 | Kondou et al. | |
| 2009/0191768 | A1 | 7/2009 | Shimizu et al. | 439/816 |
| 2011/0174868 | A1 | 7/2011 | Higai et al. | |
| 2020/0096932 | A1 | 3/2020 | Kobayashi et al. | |

FOREIGN PATENT DOCUMENTS

| | | | |
|---|---|---|---|
| CN | 101494333 | | 7/2007 |
| CN | 102164691 | A | 8/2011 |
| CN | 203309385 | U | 11/2013 |
| CN | 105221856 | A | 1/2016 |
| CN | 105276302 | A | 1/2016 |
| JP | S53-65257 | A | 6/1978 |
| JP | H5-71014 | U | 9/1993 |
| JP | 2001-212613 | A | 8/2001 |
| JP | 2001-286958 | A | 10/2001 |
| JP | 2002-178029 | A | 6/2002 |
| JP | 2011-247299 | A | 12/2011 |

OTHER PUBLICATIONS

Written Opinion in International Application No. PCT/JP2018/020794 dated Aug. 14, 2018.
International Search Report in International Application No. PCT/JP2018/020794 dated Aug. 14, 2018.
Office Action dated Oct. 13, 2021 in counterpart Chinese Application No. 201880034612.9, together with English translation thereof.

* cited by examiner

METAL PLATE AND METHOD OF PRODUCING TUBULAR BODY

CROSS-REFERENCE TO RELATED APPLICATIONS

This application is a Continuation of International Patent Application No. PCT/JP2018/020794, filed May 30, 2018, which claims the benefit of Japanese Patent Application No. 2017-108065, filed May 31, 2017, both of which are hereby incorporated by reference herein in their entirety.

BACKGROUND OF THE INVENTION

Field of the Invention

The present invention relates to a metal plate and a method of manufacturing a tubular body.

Background Art

Conventionally, a technique for manufacturing a tubular body by performing various processes on a metal plate has been proposed.

For example, Patent Document 1 discloses that a rectangular tubular body is formed by bending a metal plate. Patent Document 2 discloses that a tubular body is formed by fitting a metal plate with a squared-U shape in a cross-section and a flat metal plate to each other and by fastening these plates. This fastening is performed by caulking the fitting portion by applying to the metal plate a force along the plane of the metal plate.

However, in the configuration disclosed in Patent Document 1, the joint of the metal plate may open due to the spring back.

Further, it is necessary to process two metal plates in the configuration disclosed in Patent Document 2. Thus, there is a concern that workability deteriorates as the number of processing steps increases. In addition, when the two metal plates are combined, the protruded portion and the recessed portion interfere with each other in the fitting portion, so that the portion is likely to buckle when both are combined or when pressure is applied and caulked. Thus, there is a concern that the precision of the fitting and the adhesiveness of the metal plates at the joint may deteriorate.

Therefore, the present invention has been made in view of such a situation, and the object of the present invention is to provide a tubular body formed by combining one end of a single metal plate with another end of the single metal plate, wherein both ends can stably adhere to each other.

CITATION LIST

Patent Literature

Patent Literature 1: Japanese Patent Application Laid-Open Publication No. S53-65257

Patent Literature 2: Japanese Patent Application Laid-Open Publication No. 2002-178029

SUMMARY OF THE INVENTION

A representative configuration for achieving the above object is a metal plate for forming a tubular body by facing one end surface of the metal plate to another end surface of the metal plate, comprising:

a recessed portion provided at the one end surface by cutting out the metal plate in a planar direction of the metal plate, the recessed portion having an engaging portion inside the recessed portion; and a protruding portion provided at a position on the another end surface, the position corresponding to that of the recessed portion, the protruding portion protruding in the planar direction, the protruding portion being engaged with the engaging portion by applying a bending process such that the engaging portion is hooked by the protruding portion, wherein a length from a proximal end portion to a distal end portion of the protruding portion before the bending process is applied is equal to or less than a depth of the recessed portion at a position of the recessed portion, the position facing an end surface of the proximal end portion of the protruding portion.

Further features of the present invention will become apparent from the following description of exemplary embodiments with reference to the attached drawings.

DESCRIPTION OF THE EMBODIMENTS

First Embodiment

Hereinafter, the configuration of a metal plate according to the first embodiment of the present invention will be described with reference to the drawings. Note that the dimensions, materials, shapes, relative arrangements, and the like of the described components are not intended to limit the scope of the present invention only to those unless otherwise specified.

Figure 1:
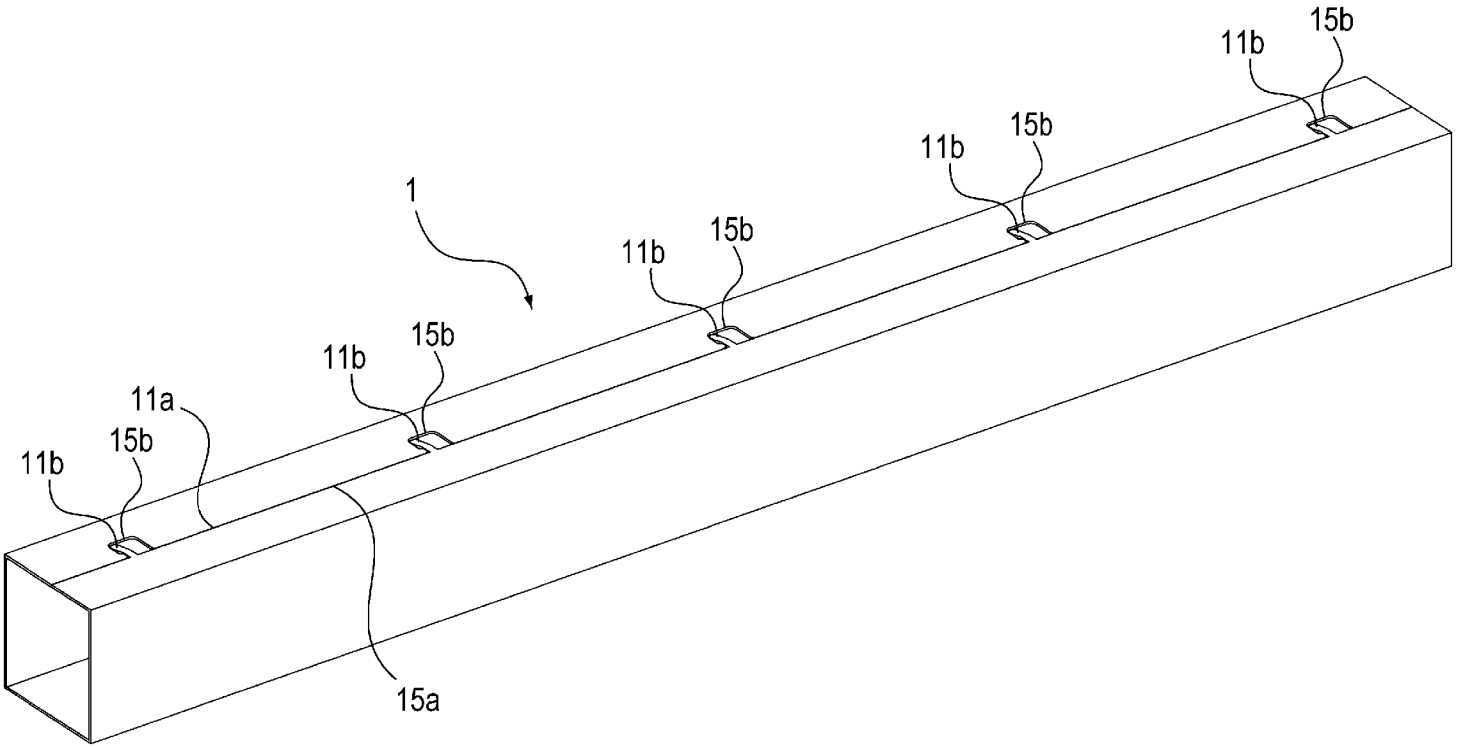
FIG. 1 is a perspective view of a tubular body.
Figure 2:
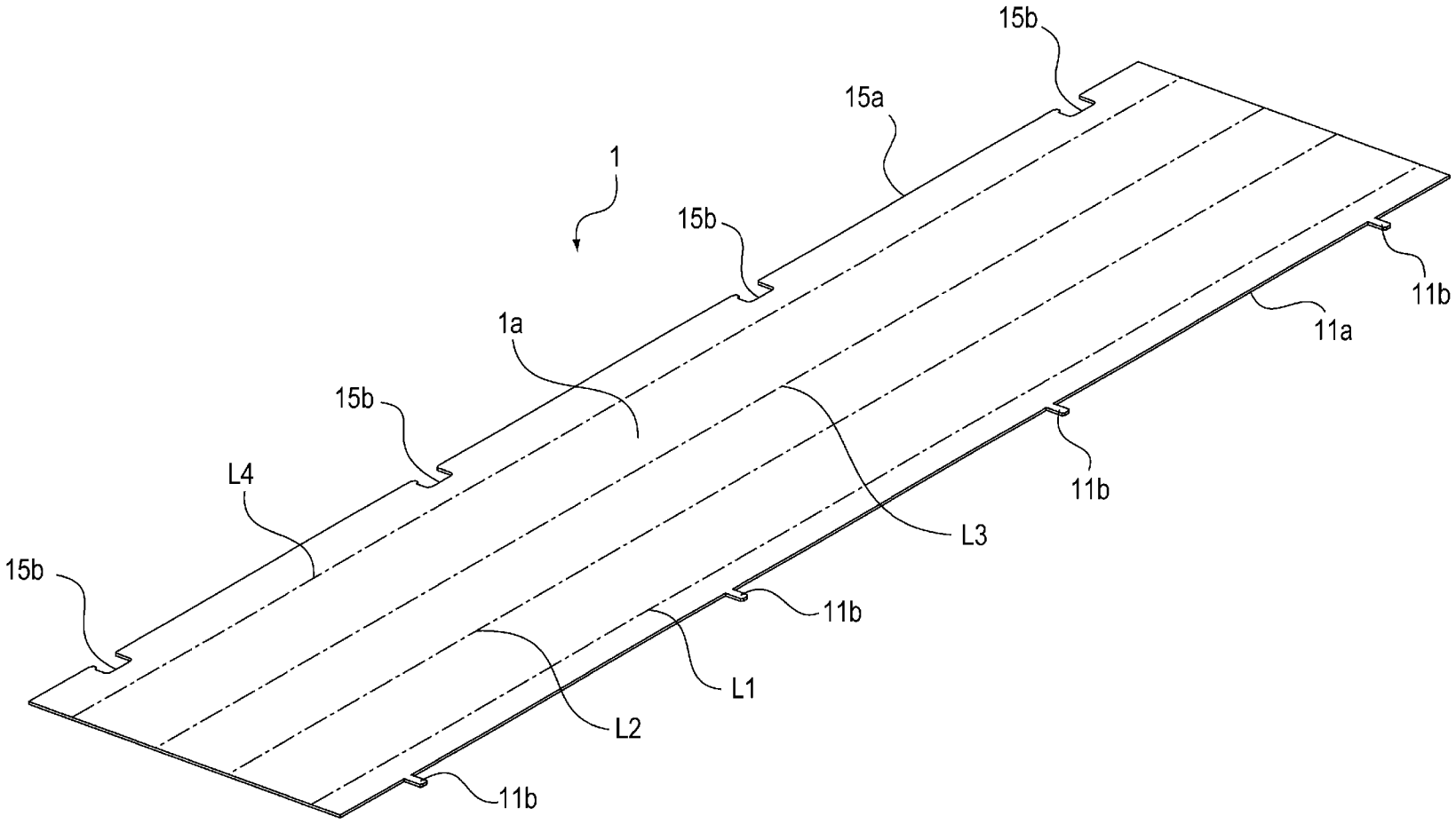
FIG. 2 is a developed perspective view of the tubular body.

FIG. 1 is a perspective view of the tubular body 1, and FIG. 2 is a developed perspective view of the tubular body 1. As shown in FIGS. 1 and 2, the tubular body 1 has a prism shape and is formed by bending the sheet metal 1*a* by 90 degrees along four parallel lines L1 to L4, respectively, and by joining the end portion 11*a* (one end portion) with the end portion 15*a* (the other end portion). The end portion 11*a* forms one side of the metal plate 1*a* and is substantially parallel to the lines L1 to L4. The end portion 15*a* forms another side of the sheet metal 1*a* and is substantially parallel to the lines L1 to L4. The end portion 11*a* and the end portion 15*a* of the metal plate 1*a* before the bending process are the sides placed in opposite directions with respect to the lines L1 to L4. Here, in this embodiment, the metal plate 1*a* is an electro-galvanized steel plate formed by the punching process from a metal plate having a thickness of 1 mm as a raw material. Moreover, the outer dimension of the tubular body 1 is 18 mm×25 mm, and the full length is 500 mm. The material of the metal plate 1*a* is not limited to this, and may be a stainless or aluminum material. Moreover, although the thickness of the sheet metal 1*a* is exemplified as 1 mm, the thickness of the metal plate 1*a* is desirably 0.4 mm or more and 2 mm or less.

Next, the joint between the end portion 11*a* (end surface) and the end portion 15*a* (end surface) of the metal plate 1*a* of the tubular body 1 will be described. As shown in FIG. 2, each of the end portion 11*a* and the end portion 15*a* forms a side of the metal plate 1*a*. The X-axis direction in FIG. 2 is defined as a first direction in which the first side formed by the end portion 11*a* of the metal plate 1*a* and the second side formed by the end portion 15*a* extend. The first side and the second side are parallel to each other. Further, the Y-axis direction perpendicular to the X-axis direction is defined as a second direction in which the third side and the fourth side of the metal plate 1*a* extend. The third side and the fourth side are respectively perpendicular to the first side and the second side. A direction along the planar defined by the X-axis direction and the Y-axis direction is a planar direction of the metal plate 1*a* before pressing. Furthermore, the Z-axis direction is defined as a third direction that is the thickness direction of the metal plate 1*a*. The Z-axis direction is a direction perpendicular to the X-axis and the Y-axis. At the end 15*a* of the metal plate 1*a*, the recess 15*b* is formed by cutting out the metal plate 1*a* in the planar direction. Further, at a position corresponding to the recessed portion 15*b* at the end portion 11*a* of the metal plate 1*a*, a protruding portion 11*b* is formed which protrudes in the planar direction of the metal plate 1*a*. The dashed-dotted line shown in FIG. 2 is a bending line along which the metal plate 1*a* is bent in the press work mentioned later. The protruding portion 11*b* is disposed within the range of the width in the X-axis direction of the recessed portion 15*b*. Therefore, as described later, when the metal plate 1*a* is bent along the dashed-dotted line, the protruding portion 11*b* fits into the recessed portion 15*b* formed by an end surface (surface along the thickness direction of the metal plate 1*a*). The length (the length in the Y-axis direction) from the proximal end portion to the distal end portion of the protruding portion 11*b* is equal to or less than the depth in the Y-axis direction of the recessed portion 15*b* at a position corresponding to the protruding portion 11*b*. In this embodiment, since the rectangular metal plate 1*a* is used, the third side and the fourth side are parallel to the first side and the second side. However, it is not necessary for the third side and the fourth side to be parallel to the first side and the second side. Further, it is not necessary for the third side to be parallel to the fourth side. Furthermore, the end portion of the metal plate 1*a* connecting the first side and the second side may be formed by a plurality of sides instead of the third side and the fourth side.

Figure 3A:
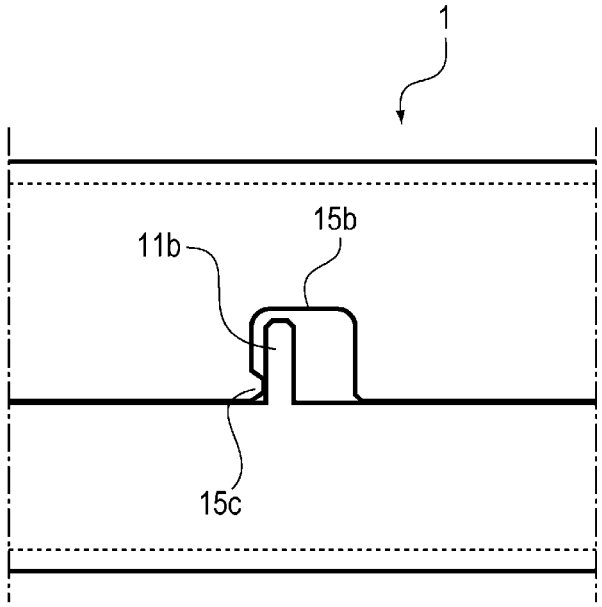
FIGS. 3A and 3B are partial enlarged views of a protruding portion and a recessed portion.
Figure 3B:
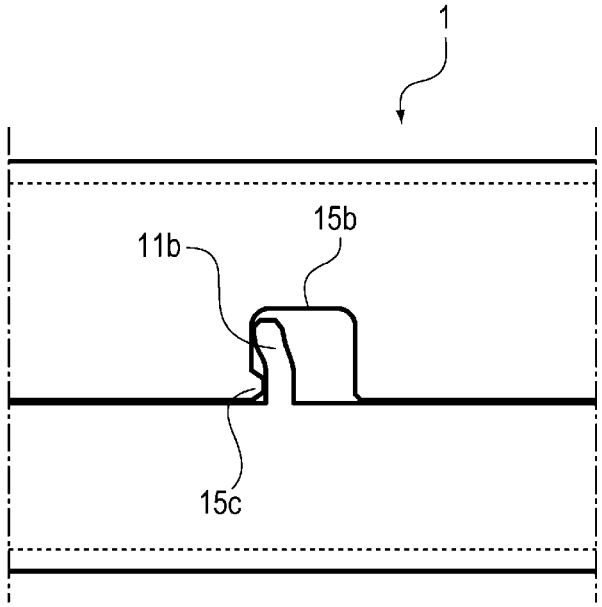

FIGS. 3A and 3B are partially enlarged views of the protruding portion 11*b* and the recessed portion 15*b*. FIG. 3A shows a state where the protruding portion 11*b* is not yet deformed (before processing). FIG. 3B shows a state where the protruding portion 11*b* has already been deformed (after processing). As shown in FIGS. 3A and 3B, the protruding portion 15*c* is provided at the recessed portion 15*b*. As shown in FIG. 3A, the protruding portion 15*c* is provided in the recessed portion 15*b* such that the protruding portion 15*c* is so positioned that the protruding portion 15*c* is located closer to the proximal end portion of the protruding portion 11*b* than the distal end portion of the protruding portion 11*b* when the end portion 11*a* and the end portion 15*a* are joined. The protruding portion 15*c* is provided in the recessed portion 15*b* such that the protruding portion 15*c* protrudes toward the protruding portion 11*b* when the end portion 11*a* and the end portion 15*a* are joined. That is, the protruding portion 15*c* is a portion protruding in the longitudinal direction of the tubular body 1. In joining the end portion 11*a* and the end portion 15*a* of the metal plate 1*a*, the protruding portion 11*b* is bent in the left direction in FIGS. 3A and 3B after being fitted in the recessed portion 15*b*. As a result, the protruding portion 11*b* is plastically deformed and hooks the protruding portion 15*c* so that the protruding portion 11*b* engages with the protruding portion 15*c* (engaging portion) at a position where the side surface of the protruding portion 11*b* is opposed to the protruding portion 15*c* which is formed to protrude in the longitudinal direction of the tubular body 1.

As described above, by engaging the protruding portion 11*b* with the protruding portion 15*c* such that the protruding portion 15*c* is hooked by the protruding portion 11*b* at the joint of the end portions 11*a* and 15*a* of the metal plate 1*a*, the adhesion between the end portions 11*a* and 15*a* is maintained, resisting the force in a direction in which the end portions 11*a* and 15*a* separate from each other, namely, the force for opening the metal plate 1*a* due to the spring back.

Moreover, when the length from the proximal end portion to the distal end portion of the protruding portion 11*b* is set to be less than the depth of the recessed portion 15*b* located at a position corresponding to the protruding portion 11*b*, the protruding portion 11*b* s prevented from buckling when the side portion 11*a* and the side portion 15*a* are joined. In addition, the depth here is defined as the distance between the end portion 15*a* and the surface of the recessed portion 15*b* opposed to the distal end portion of the protruding portion 11*b*. Therefore, the accuracy of the engagement of the protruding portion 11*b* with the protruding portion 15*c* is maintained.

Therefore, with the configuration described above, the end portion 11*a* and the end portion 15*a* stably adhere to each other at the joint between the end portion 11*a* and the end portion 15*a* in the tubular body 1 formed from the single sheet of the metal plate 1*a*.

Next, a method of manufacturing the tubular body 1 will be described.

Figure 4A:
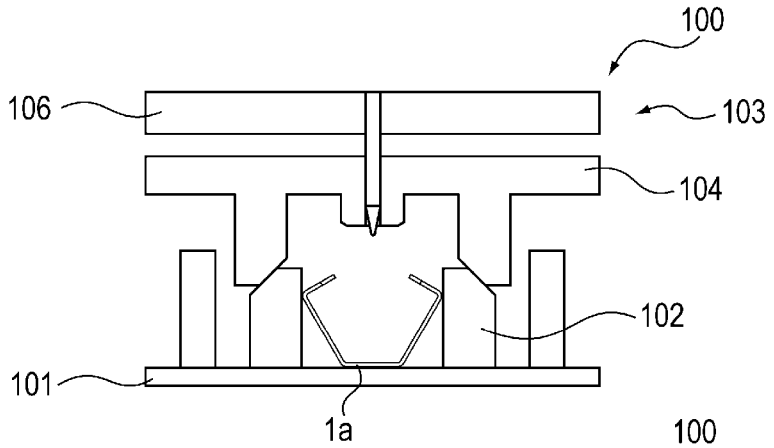
FIGS. 4A to 4D are schematic diagrams for explaining a bending process in manufacturing the tubular body.

FIGS. 4A, 4B, 4C and 4D are schematic diagrams for explaining a bending process when the tubular body 1 is manufactured. When manufacturing the tubular body 1, as shown in FIG. 4A, the metal plate 1*a* is firstly bent along the lines L 1 to L 4 (see FIGS. 2A and 2B) by the press machine 100, and then the metal plate 1*a* is set so as to be nipped between the slide blocks 102 on the base plate 101 of the press machine 100.

Figure 4B:
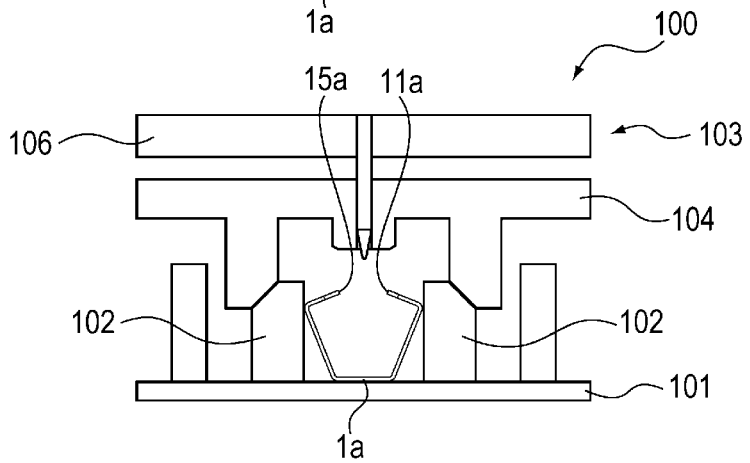
Figure 4C:
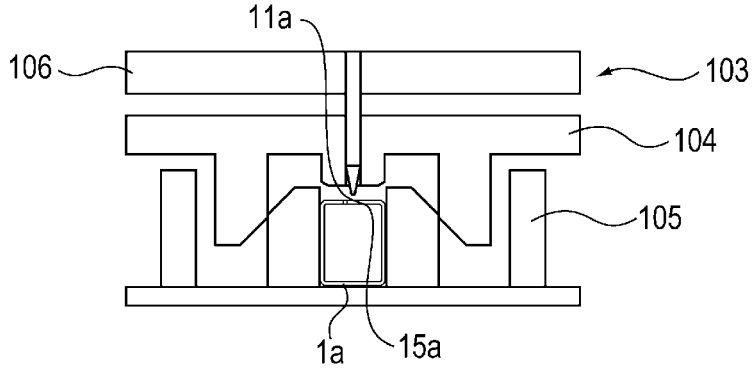

Next, as shown in FIG. 4B, by lowering the upper die 103, the slide blocks 102 approach each other on the base plate 101, and accordingly the end portions 11*a* and 15*a* of the metal plate 1*a* approach each other. Thereafter, when the upper die 103 is further lowered, as shown in FIG. 4C, the end portion 11*a* and the end portion 15*a* of the metal plate 1*a* are joined.

Figure 4D:
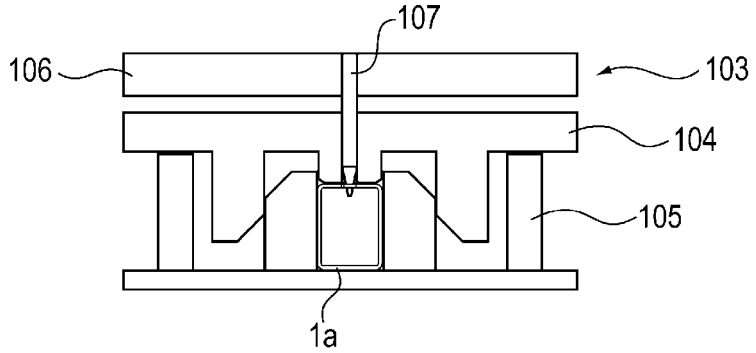

Next, as shown in FIG. 4D, when the upper die 103 is further lowered, the slide plate 104 abuts against the stopper block 105 and the lowering of the slide plate 104 is restricted. When the upper die 103 is lowered in this state, only the punch plate 106 with the caulking punch 107 (pressing member) descends, and the caulking punch 107 enters the recessed portion 15*b* of the metal plate 1*a*. The caulking punch 107 includes the tapered portion 107*a* at the distal end portion. The tapered portion 107*a* is inclined with a taper angle of 20° to the entering direction.

Figure 5:
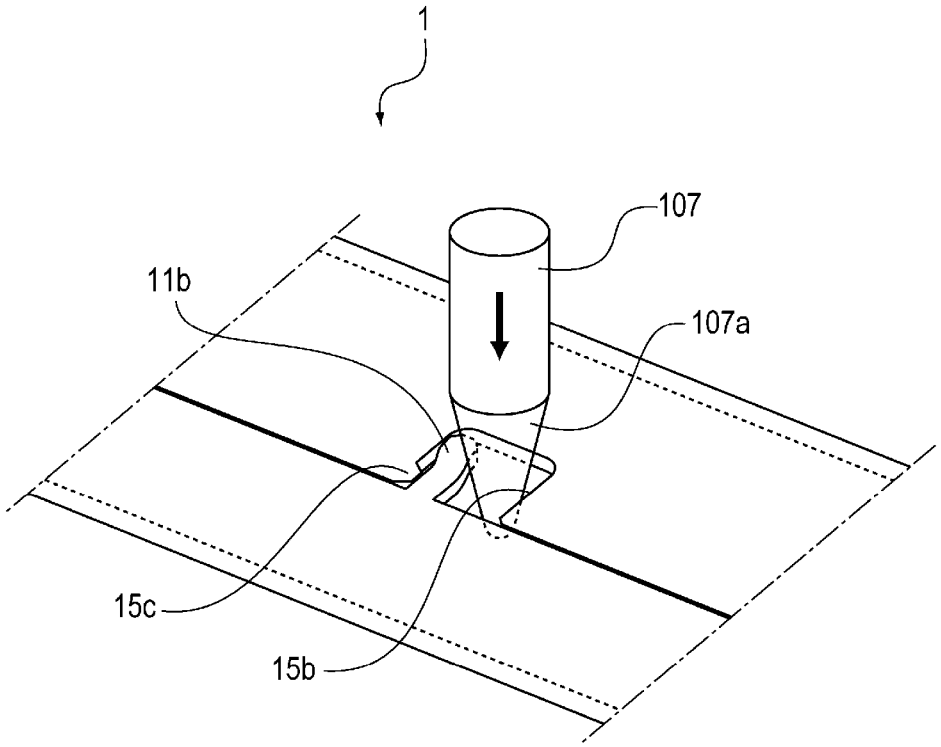
FIG. 5 is a perspective view showing a state where the caulking punch enters the recessed portion.

FIG. 5 is a perspective view showing a state where the caulking punch 107 enters the recessed portion 15*b*. As shown in FIG. 5, in the state where the protruding portion 11*b* is placed in the recessed portion 15*b* of the metal plate 1*a*, the caulking punch 107 enters the space surrounded by the recessed portion 15*b*, the protruding portion 11*b* and the end portion 15*a* which are located at an opposite side of the protruding portion 15*c* with respect to the protruding portion 11*b*. Accordingly, the protruding portion 11*b* is pressed and bent in the longitudinal direction of the tubular body 1 by the taper portion 107*a* of the caulking punch 107. As a result, the protruding portion 11*b* is caulked such that the protruding portion 11*b* is engaged with the protruding portion 15*c* so that the protruding portion 15*c* is hooked by the protruding portion 11*b*, thereby forming the tubular body 1 with the end portion 11*a* and the end portion 15*a* being joined with high adhesion.

In the present embodiment, the configuration has been described in which four recessed portions 15*b* and four protruding portions 11*b* are provided in the longitudinal direction of the tubular body 1. However, the present invention is not limited to this configuration, and the number of the recessed portions 15*b* and the protruding portions 11*b* can be appropriately changed.

Moreover, in the present embodiment, the configuration has been described in which the bending directions of the four protruding portions 11*b* are the same. However, the present invention is not limited to this configuration, and a configuration in which the bending direction of the protruding portions 11*b* and the arrangement of the protruding portion 15*c* are reversed in the longitudinal direction of the tubular body 1 or a configuration in which both configurations are mixed may be employed.

Second Embodiment

Next, the configurations of the second embodiment of the tubular body according to the present invention will be described with reference to the drawings. The portions whose descriptions are duplicate with those of the first embodiment are omitted by attaching the same reference numerals as those of the first embodiment.

Figure 6:
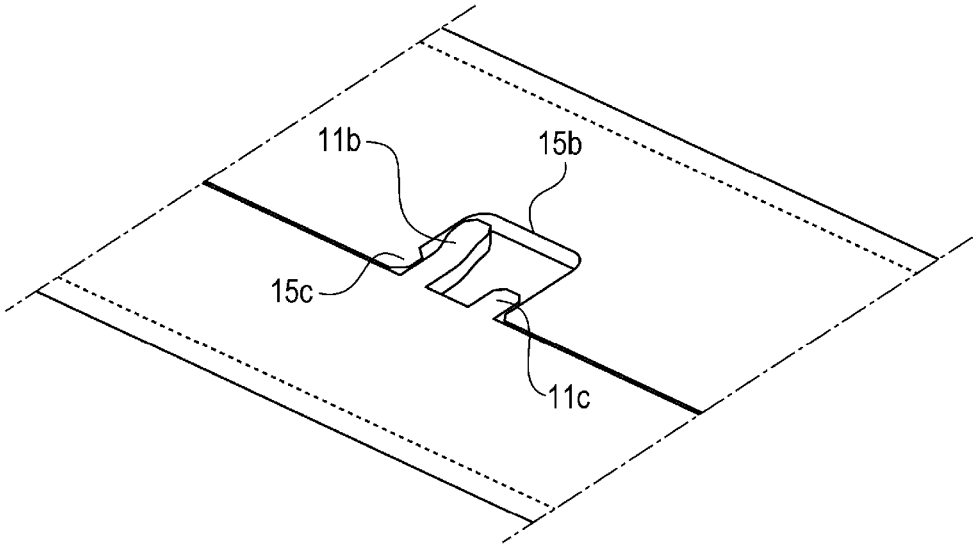
FIG. 6 is a partially enlarged view of a protruding portion and a recessed portion.

FIG. 6 is a partially enlarged view of the protruding portion 11*b* and the recessed portion 15*b* of the tubular body 1 according to the present embodiment. As shown in FIG. 6, the end portion 11*a* of the metal plate 1*a* is provided with a movement restricting protrusion 11*c* (restricting portion) which engages with the recessed portion 15*b* of the end portion 15*a* on the opposite side of the protruding portion 11*b* in the longitudinal direction of the tubular body 1. The movement restricting protrusion 11*c* engages with the recessed portion 15*b* without being bent, unlike the protruding portion 11*b*.

By providing the movement restricting projection 11*c* that engages with the protruding portion 15*b* separately from the convex portion 11*b*, it is possible to suppress a relative movement of the end portion 11*a* and the end portion 15*a* in the longitudinal direction of the tubular body 1 when the protruding portion 11*b* is bent. Accordingly, the engagement between the protruding portion 11*b* and the protruding portion 15*c* can be further stabilized, thereby securing the adhesion of the end portion 11*a* and the end portion 15*a* at the joint between them.

Figure 7:
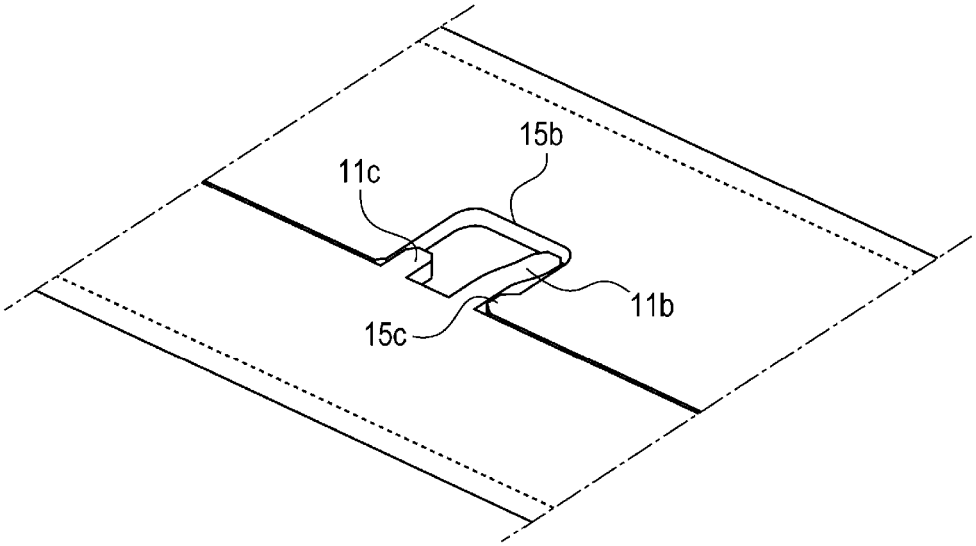
FIG. 7 is a partially enlarged view of the protruding portion and the recessed portion.

The positional relationship between the movement restricting protrusion 11*c* and the protruding portion 11*b* is not limited to the configuration of the above configuration of the present embodiment. That is, as shown in FIG. 7, for example, the positional relationship between the protruding portion 11*b* and the movement restricting protrusion 11*c* may be reversed in the longitudinal direction of the tubular body 1. Moreover, the configuration with both different positional relationships can be adopted. As a result, the movement restricting protrusions 11*c* include those of which the directions of restricting the movements are opposite to each other. Therefore, it is possible to suppress more effectively the shifting of the relative positions of the end 11*a* and the end 15*a* in the longitudinal direction of the tubular body 1.

Figure 8:
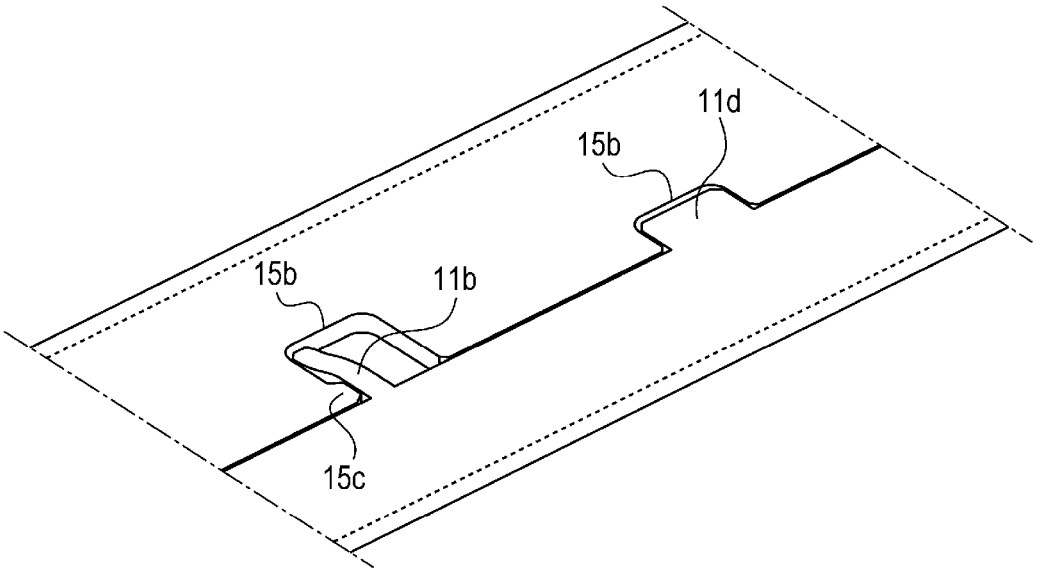
FIG. 8 is a partially enlarged view of a movement restricting protrusion and a movement restricting recessed portion.

Further, the arrangement of the movement restricting protrusions 11*c* is not limited to the above configurations of the present embodiment. That is, as shown in FIG. 8, for example, the end portion 15*a* may be provided with the movement restricting recessed portion 15*d* that engages with the movement restricting protrusion 11*c* separately from the recessed portion 15*b* which the protruding portion 11*b* enters. In this configuration, the same effect may be obtained. Alternatively, the movement restricting protrusion 11*c* may be provided at the end portion 15*a*, and the movement restricting recessed portion 15*d* may be provided at the end portion 11*a*.

Third Embodiment

Next, the configurations of the third embodiment of the tubular body according to the present invention will be described with reference to the drawings. The portions whose descriptions are duplicate with those of the first and second embodiments are omitted by attaching the same reference numerals as those of these embodiments.

Figure 9A:
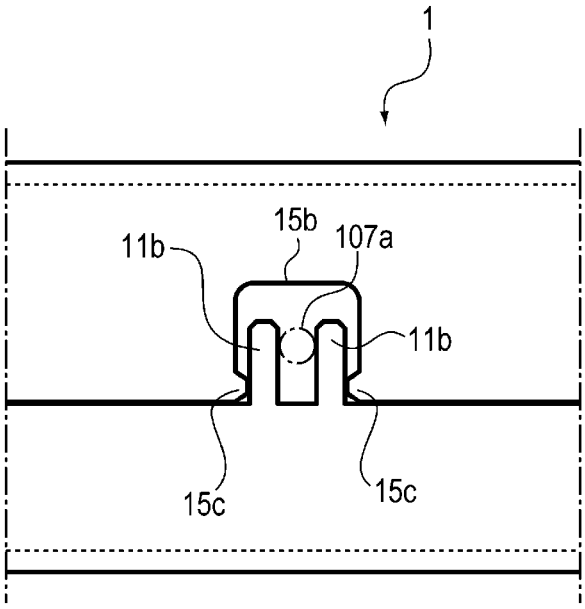
FIGS. 9A and 9B are partially enlarged views of the protruding portion and the recessed portion.
Figure 9B:
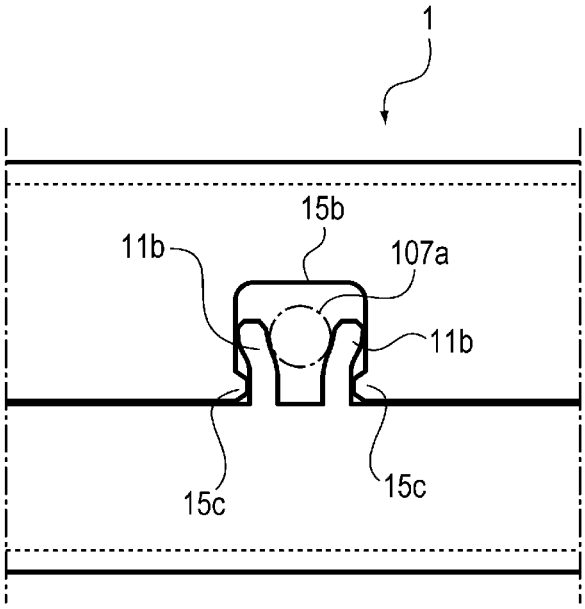

FIGS. 9A and 9B are partially enlarged views of the protruding portion 11*b* and the recessed portion 15*b* of the tubular body 1 according to the present embodiment. FIG. 9A shows a state where the protruding portion 11*b* is not yet deformed, and FIG. 9B shows a state where the protruding portion 11*b* has been deformed.

As shown in FIG. 9, in the present embodiment, a pair (a plurality) of protruding portions 11*b* formed in the end portion 11*a* enter the single recessed portion 15*b* formed at the end portion 15*a* of the metal plate 1*a*. Then, with the pair of protruding portions 11*b* being in the recessed portion 15*b*, the caulking punch 107 enters from above the space between the pair of protruding portions 11*b* positioned in the recessed portion 15*b*. Accordingly, the pair of protruding portions 11*b* are respectively bent by the tapered portion 107*a* of the caulking punch 107. The pair of protruding portions 11*b* are engaged with the pair of protrusion portions 15*c* (a plurality of engaging portion) such that the pair of protruding portions 11*b* are hooked on the pair of protrusion portions 15*c* formed to protrude in the longitudinal direction of the tubular body 1 at the portions opposed to the side surfaces of the protruding portions 11*b* positioned in the recessed portion 15*b*. The bending directions of the pair of protruding portions 11*b* are opposite to each other in the longitudinal direction of the tubular body 1.

As described above, the pair of protruding portions 11*b* are respectively engaged with the pair of protruding portions 15*c* in the recessed portion 15*b* so that the end portions of the metal plate 1*b* can stably adhere to each other at the joint between them.

Fourth Embodiment

Next, the configurations of the fourth embodiment of the tubular body according to the present invention will be described with reference to the drawings. The portions whose descriptions are duplicate with those of the first, second and third embodiments are omitted by attaching the same reference numerals as those of these embodiments.

Figure 10:
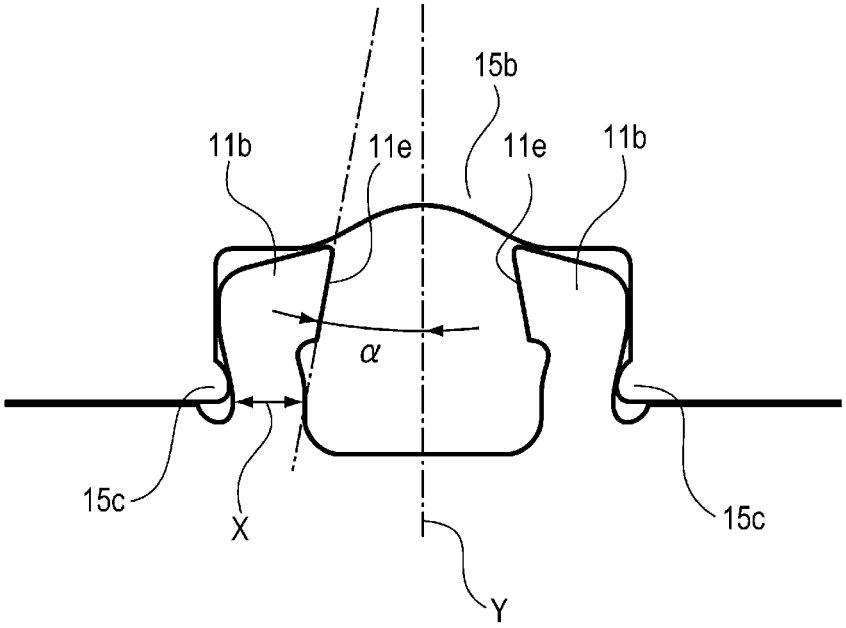
FIG. 10 is a partially enlarged view of the protruding portion and the recessed portion.

FIG. 10 is a partially enlarged view of the protruding portion 11*b* and the recessed portion 15*b* of the tubular body 1 according to the present embodiment. As shown in FIG. 10, in this embodiment, the width of the protruding portion 11*b* formed on the end portion 11*a* of the metal plate 1*a* increases from the proximal end portion to the distal end portion. Further, the edge portions 11*e* of the pair of protruding portions 11*b* against which the taper portion 107*a* of the caulking punch 107 abuts at the time of bending are inclined an angle α with respect to the line Y connecting the centers of the distances between both protruding portions 11*b* such that the gap between both edge portions becomes narrower from the proximal end to the distal end.

Figure 11A:
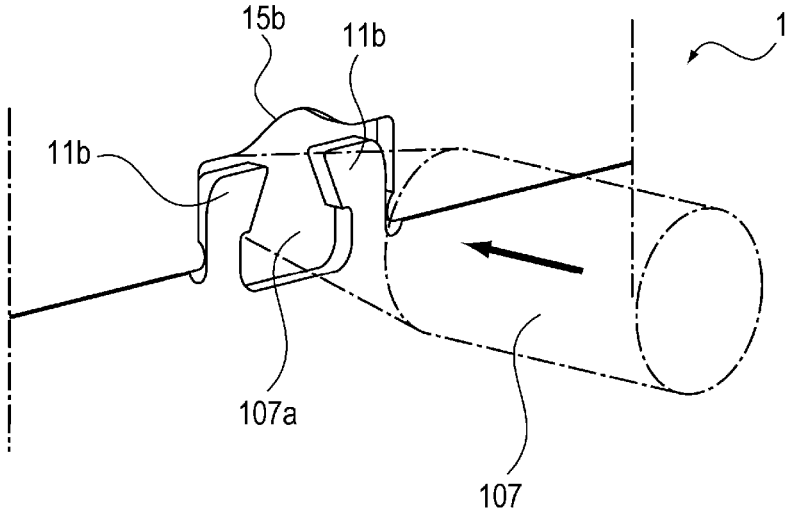
FIGS. 11A to 11C are schematic perspective views for explaining a bending process for bending the protruding portion.
Figure 11B:
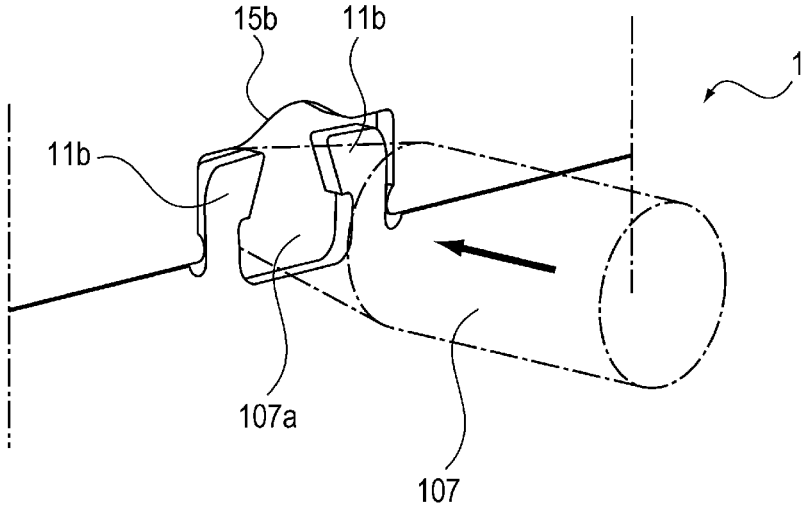
Figure 11C:
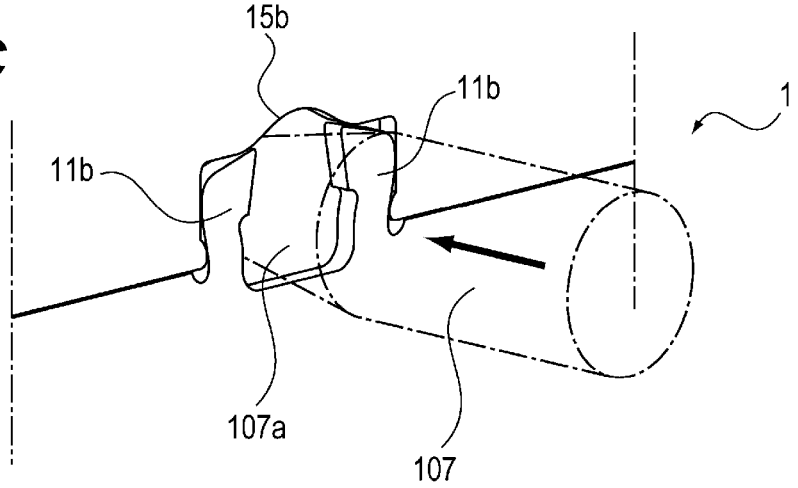
Figure 12A:
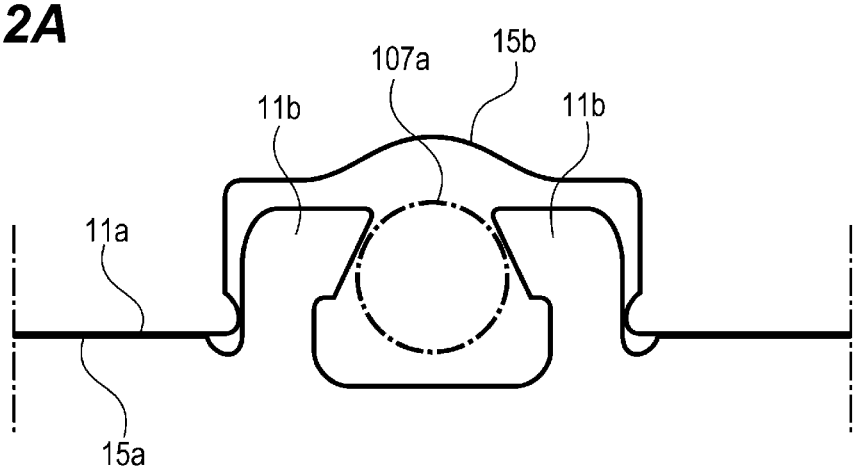
FIGS. 12A to 12C are schematic plan views for explaining the bending process for bending the protruding portion.
Figure 12B:
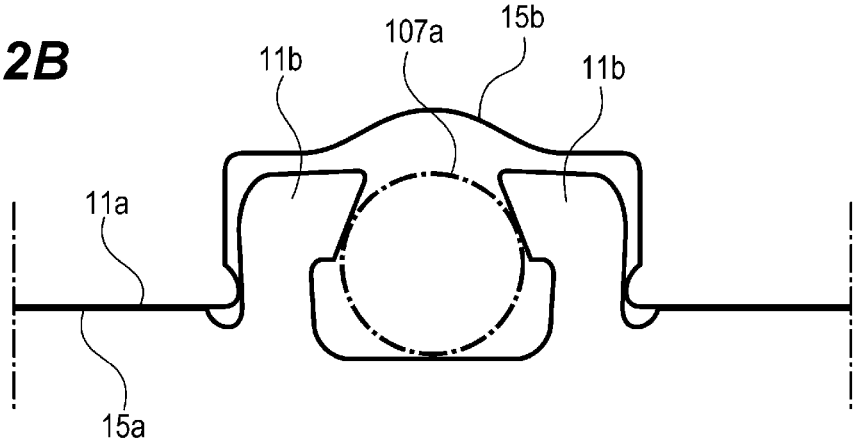
Figure 12C:
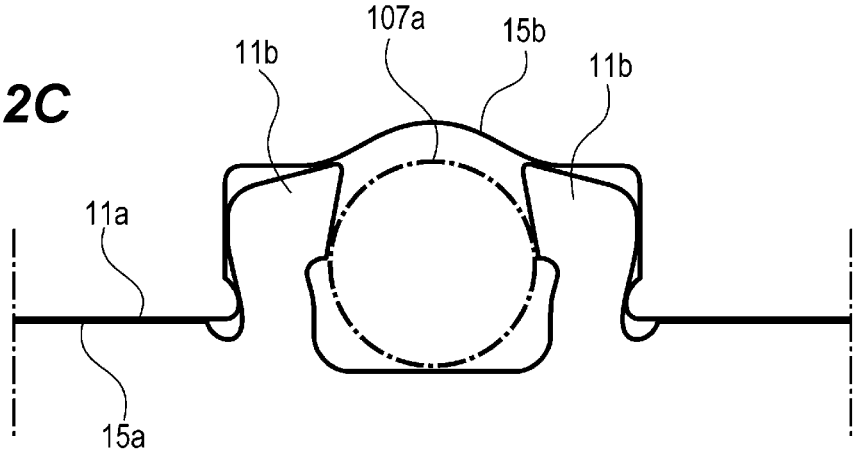

FIGS. 11A, 11B and 11C are schematic perspective views which illustrate the step of bending the protruding portion 11*b* in the bending process by the above-described caulking punch 107. FIGS. 12A, 12B and 12C are schematic plan views respectively corresponding to FIGS. 11A, 11B and 11C. Here, in FIGS. 11A to 11C and 12A to 12C, the manner in which the caulking punch 107 descends is shown in the order of FIGS. 11A to 11C and FIGS. 12A to 12C. A dashed-dot line shown in FIGS. 12 A to 12C indicates a cross-section of the caulking punch 107 on the plane of the metal plate.

As shown in FIGS. 11A to 11C and 12A to 12C, when the protruding portion 11*b* is bent and caulked, the caulking punch 107 gradually enters the recessed portion 15*b* from above, and the taper portion 107*a* of the caulking punch 107 presses the edge portion 11*e* of the protruding portion 11*b* to bend the protruding portion 11*b*. As a result, the protruding portion 11*b* engages the protruding portion 15*c* such that the protruding portion 11*b* is hooked on the protruding portion 15*c* that protrudes in the longitudinal direction of the tubular body 1 the portion opposed to the side surface of the protruding portion 11*b* positioned in the recessed portion 15*b*.

As described above, the edge portions 11*e* are inclined at an angle α with respect to the line Y (see FIG. 10). For this reason, in the process of bending the protruding portion 11*b* by the caulking punch 107, a force may be generated in a direction from the end portion 11*a* toward the end portion 15*a*, thereby improving adhesion between the end portion 11*a* and the end portion 15*a*.

In addition, it is preferable that the width X (see FIGS. 11A, 11B and 11C) of the proximal end part of the protruding portion 11*b* is 0.5 to 1.5 times the thickness of the metal plate 1*a*. When the width X is less than 0.5 times the thickness, the caulking strength is weak and the joint between the end portion 11*a* and the end portion 15*a* is easily opened against the force of the spring-back of the bending process. When the width X is larger than 1.5 times, there is a possibility that the protruding portion 11*b* is bent toward the inside of the tubular body 1 when the protruding portion 11*b* is pressed by the caulking punch 107 in the bending process described so that the caulking strength becomes weak.

In the present embodiment, an electro-galvanized steel plate having a thickness of 1 mm is used as the metal plate 1*a*, and the metal plate 1*a* is processed such that the width X is 1.3 mm. As a result, a sufficient caulking strength was obtained although the distal end of the protruding portion 11*b* is bent toward the inside of the tubular body 1 about 0.2 mm in the bending process by the above-described caulking punch 107. In addition, when the distal end of the protruding portion 11*b* enters the inside of the tubular body 1 in this way, the protruding portion does not outwardly protrude from the outer surface of the tubular body 1. Thus, when the tubular bodies 1 are combined with each other or the tubular body 1 is combined with other members, the tubular body 1 does not interfere with other tubular bodies 1 or other members.

First Modification Example

Next, as a first modification example of the present embodiment, the configuration will be described in which the abutting portion 11*f* is provided at the end portion 11*a* of the metal plate 1*a*.

Figure 13:
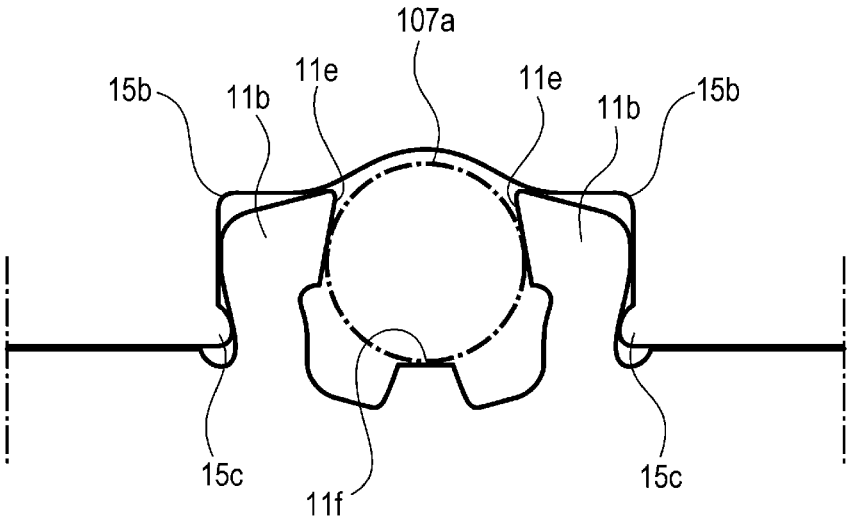
FIG. 13 is a partially enlarged view of the protruding portion and the recessed portion.

FIG. 13 is a partially enlarged view of the protruding portion 11*b* and the recessed portion 15*b* according to the first modification example. As shown in FIG. 13, in the first modification example, the abutting portion 11*f* is provided which abuts against the taper portion 107*a* of the caulking punch 107 together with the pair of protruding portions 11*b* when the caulking punch 107 enters the recessed portion 15*b* in the bending process by the caulking punch 107.

Thus, when the protruding portion 11*b* is bent by the caulking punch 107, the caulking punch 107 can be supported at three points, and a load can be stably applied to the protruding portion 11*b*. Therefore, the accuracy of the engagement of the protruding portion 11*b* with the protruding portion 15*c* is improved.

Second Modification Example

Next, as a second modification example of the present embodiment, the configuration will be described in which the hole 11*g* is provided in the vicinity of the abutting portion 11*f*.

Figure 14:
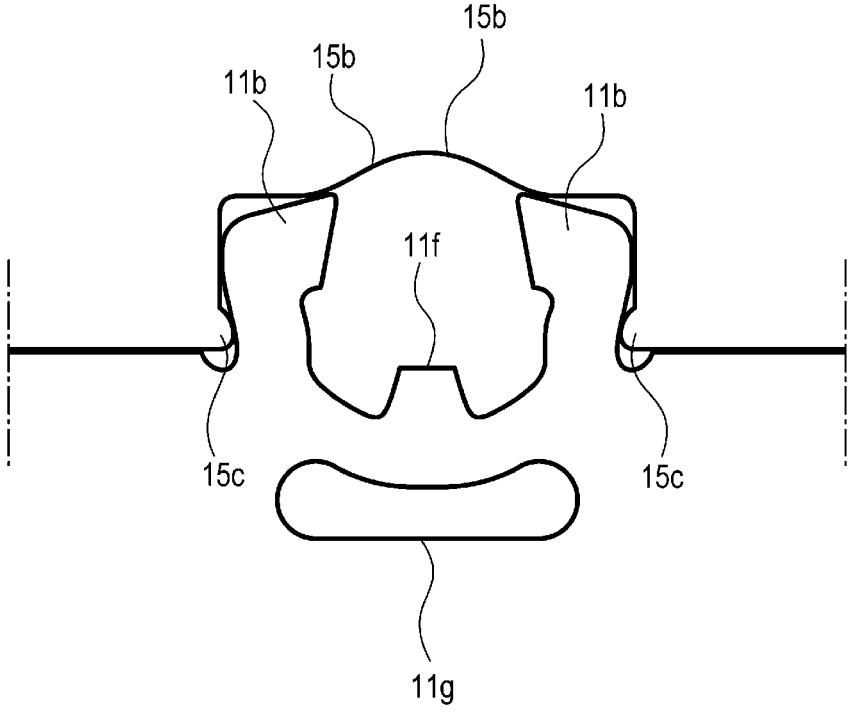
FIG. 14 is a partially enlarged view of the protruding portion and the recessed portion.

FIG. 14 is a partially enlarged view of the protruding portion 11*b* and the recessed portion 15*b* according to the second modification example. As shown in FIG. 14, in the second modification example, the hole 11*g* is provided in the vicinity of the abutting portion 11*f* in addition to the configuration of the first modification example. Next, the bending process of the protruding portion 11*b* in this configuration will be described.

Figure 15A:
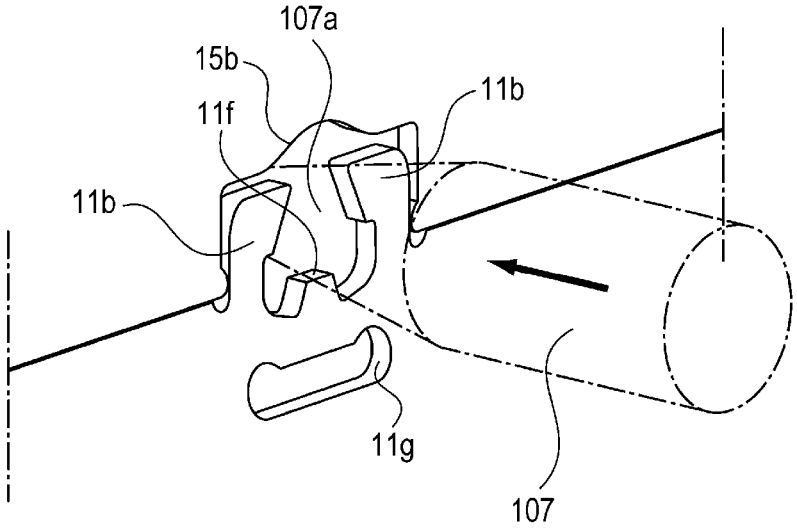
FIGS. 15A, to 15C are schematic perspective views for explaining a bending process for bending the protruding portion.
Figure 15B:
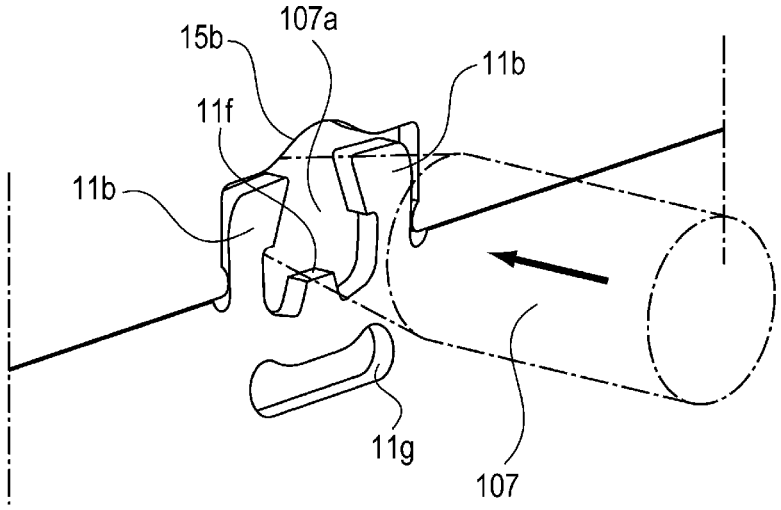
Figure 15C:
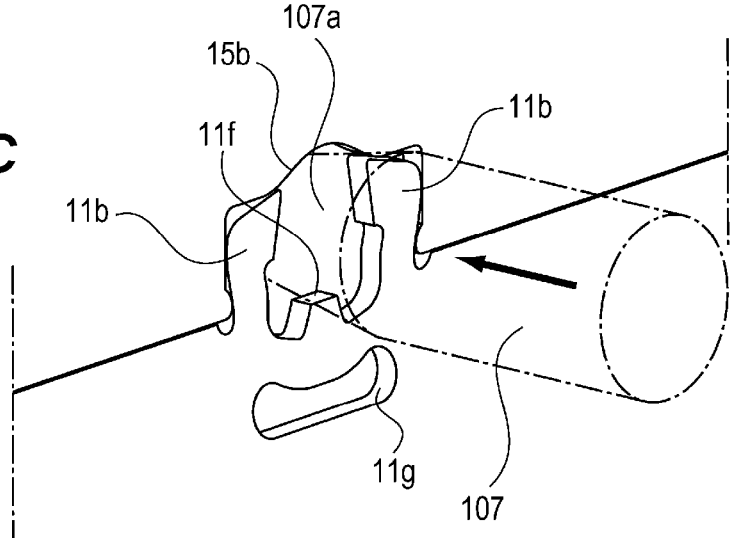
Figure 16A:
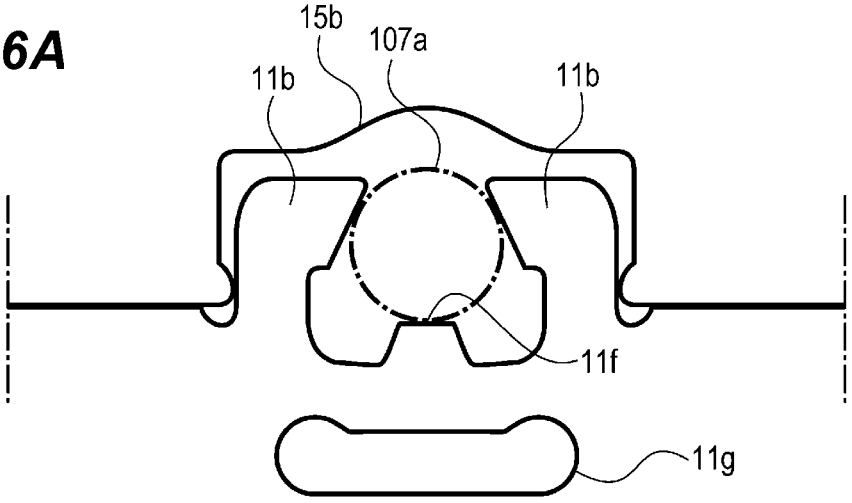
FIGS. 16A to 16C are schematic plan views for explaining the bending process for bending the protruding portion.
Figure 16B:
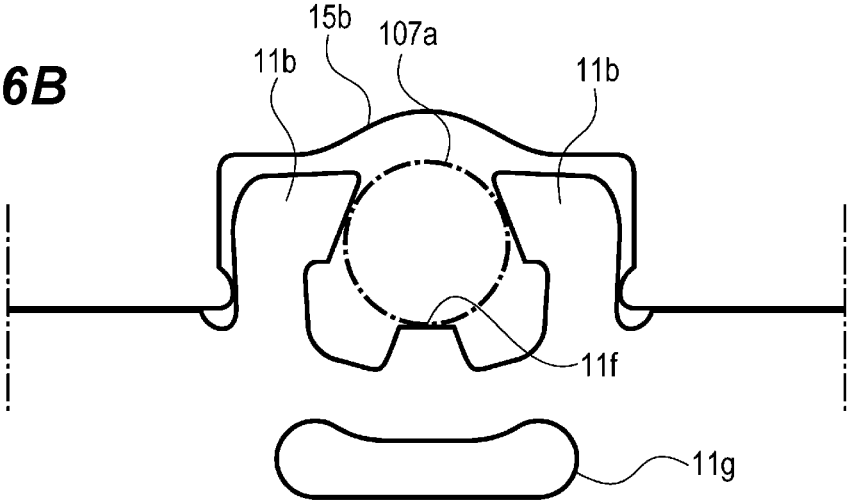
Figure 16C:
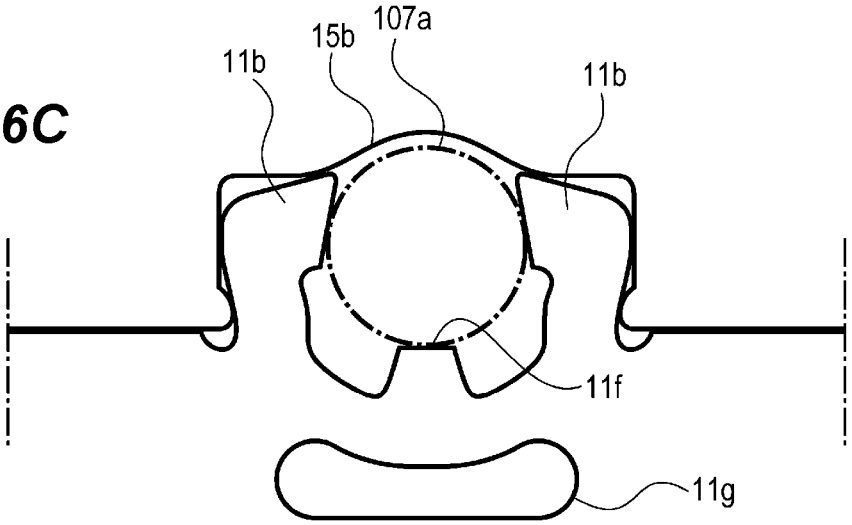

FIGS. 15A, 15B and 15C are schematic perspective views which illustrate the step of bending the protruding portion 11*b* in the bending process by the above described caulking punch 107. FIGS. 16A, 16B and 16C are schematic plan views respectively corresponding to FIGS. 15A, 15B and 15C. Here, in FIGS. 15A to 15C and 16A to 16C, the manner in which the caulking punch 107 descends is shown in the order of FIGS. 15A to 15C and FIGS. 16A to 16C. A dashed-dot line shown in FIGS. 16 A to 16C indicates a cross-section of the caulking punch 107 on the plane of the metal plate.

As shown in FIGS. 15A to 15C and 16A to 16C, when the protruding portion 11*b* is bent, the caulking punch 107 gradually enters the recessed portion 15*b* from above, and the taper portion 107*a* of the caulking punch 107 presses the protruding portion 11*b* to bend the protruding portion 11*b*. As a result, the protruding portion 11*b* engages the protruding portion 15*c* such that the protruding portion 11*b* is hooked on the protruding portion 15*c*.

When the protruding portion 11 *b* is bent by the caulking punch 107, the hole 11*g* contracts due to the pressure from the caulking punch 107 received by the abutting portion 11*f* that abuts against the caulking punch 107 together with the protruding portion 11*b*. As a result, the abutting portion 11*f* moves in a direction in which the abutting portion 11*f* retracts from the caulking punch 107. Thus, with the configuration in which the abutting portion 11*f* moves along with the protruding portion 11*b*, the movement of the axial position of the caulking punch 107 is suppressed when the protruding portion 11*b* is bent by the caulking punch 107. Therefore, the shape of the configuration of the tubular body 1 and the operation of producing it are stabilized, thereby improving takt time.

In the first to fourth embodiments, the taper angle of the caulking punch 107 is set to 20°, namely, an inclined angle of 10°. However, the present invention is not limited to this, and other taper angles may be used. However, it is preferable to satisfy $10° \leq \theta \leq 30°$ where θ represents the taper angle.

The reason why this range is selected is as follows. When the taper angle is less than 10°, there is a possibility that the lifting and lowering stroke of the caulking punch 107 becomes large and that when the caulking punch 107 is lifted, the tubular body 1 may be lifted with the caulking punch 107. Further, when the taper angle is greater than 30°, the protruding portion 11*b* may easily be bent toward the inside of the tubular body 1.

In the first to fourth embodiments, the method of processing the metal plate 1*a* using the conical caulking punch 107 is exemplified. However, the present invention is not limited to this, and may have another configuration as long as the configuration has a tapered portion. For example, the caulking punch 107 having a quadrangular pyramid shape may be used.

Figure 17A:
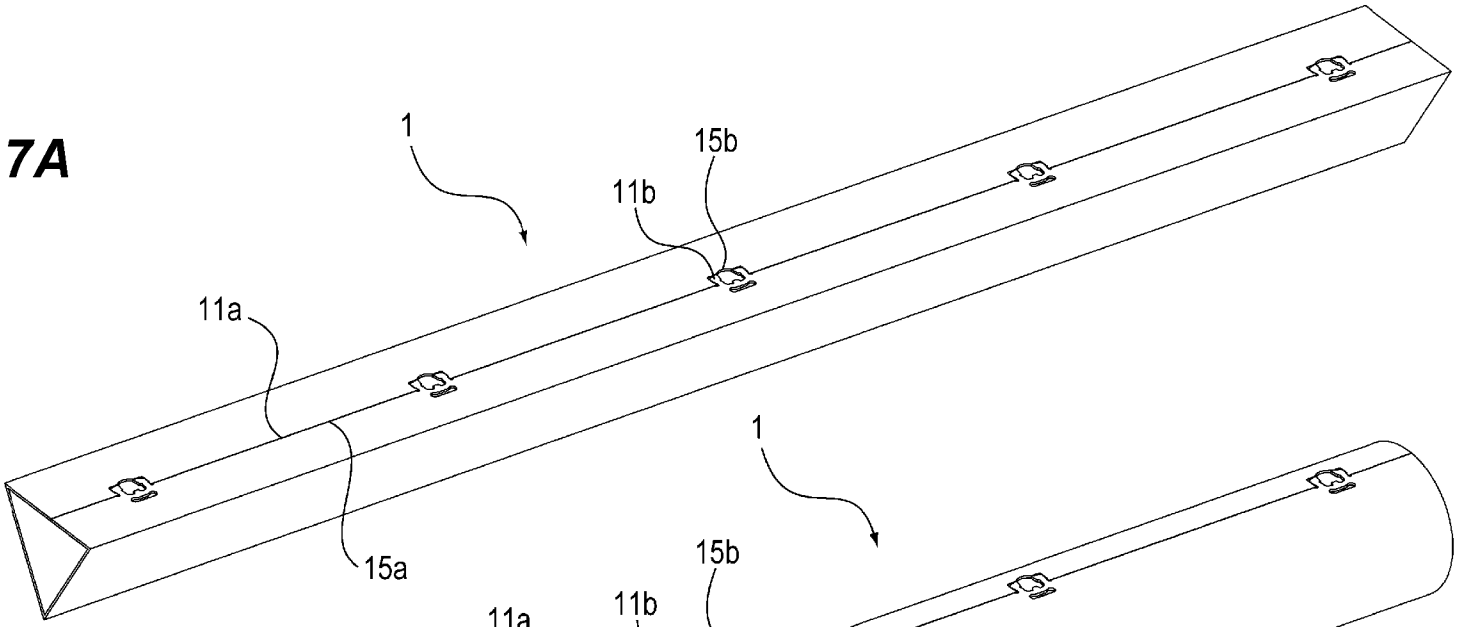
FIGS. 17A and 17B are perspective views showing a tubular body having another cross-sectional shape.
Figure 17B:
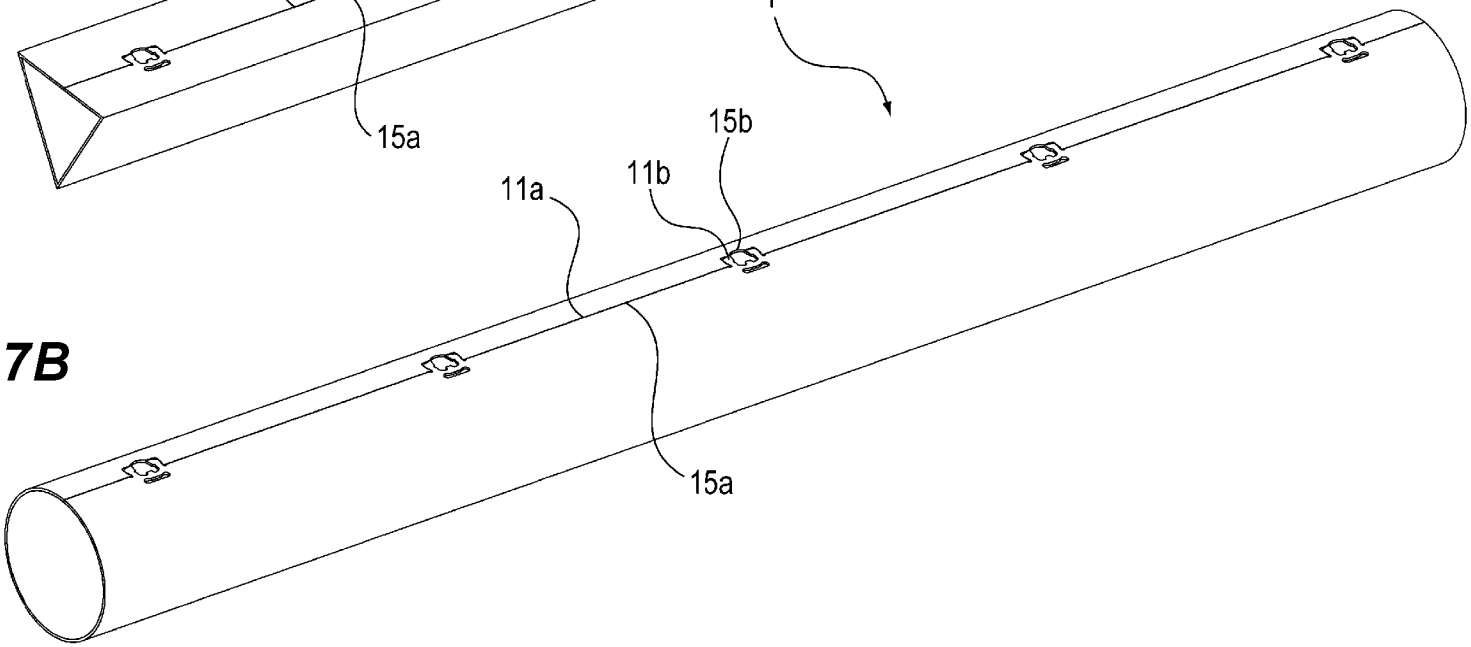

In the first to fourth embodiments, the present invention has been described by exemplifying a tubular body with a quadrangular prism shape. However, the present invention is not limited to this, can be applied to tubular bodies regardless of the cross-sectional shape of the tubular body 1, such as the tubular body with a triangular prism shape shown in FIG. 17A and the tubular body with a cylindrical shape in FIG. 17B.

Further, the tubular body 1 according to the present invention can be used for various applications including a frame of an image forming apparatus such as a multi-functional machine or a printer.

The present invention is not limited to the above embodiments, and various modifications and variations can be made without departing from the spirit and scope of the present invention. Therefore, the following claims are attached so as to make public the scope of the present invention.

According to the present invention, in a tubular body formed by combining one end of a single metal plate with another end of the single metal plate, both ends can stably adhere to each other.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

INDUSTRIAL APPLICABILITY

The present invention relates to a metal plate and a method for manufacturing a tubular body, and has industrial applicability.

The invention claimed is:

1. A method of manufacturing a tubular body formed from a metal plate, the tubular body having a recessed portion provided at one end surface of the metal plate by cutting out the metal plate in a planar direction of the metal plate; and a pair of protruding portions provided at a position on another end surface of the metal plate, the position corresponding to that of the recessed portion, the pair of protruding portions protruding in the planar direction, wherein a length from a proximal end portion to a distal end portion of the pair of protruding portions is less than a depth of the recessed portion located at the position corresponding to that of the protruding portion, wherein the method comprising:

a first step of bending the metal plate to face the one end surface to the another end surface and entering the pair of protruding portions into the recessed portion, and a second step of inserting a pressing member between the pair of protruding portions along a plate thickness direction, the pressing member being configured to press the pair of protruding portions such that the pair of protruding portions move apart from each other by deforming the pair of protruding portions to be abutted with a wall of the recessed portion and bent by a taper portion of the pressing member, the taper portion being inclined with respect to an entering direction of the pressing member and such that an engaging portion provided in the recessed portion is hooked by the pair of protruding portions.

2. The method of manufacturing a tubular body according to claim 1, wherein the tubular body has an abutting portion configured to abut against the taper portion of the pressing portion along with the pair of protruding portions when the pressing portion enters the recessed portion.

3. The method of manufacturing a tubular body according to claim 2, wherein the tubular body has a hole provided in the vicinity of the abutting portion, the hole being configured to contract by pressure when the tapered portion of the pressing member abuts against the abutting portion.

4. The method of manufacturing a tubular body according to claim 1, wherein $10° \leq \theta \leq 30°$ is satisfied where θ represents a taper angle of the taper portion of the pressing member.

5. The method of manufacturing a tubular body according to claim 1, wherein the wall of the recessed portion to which the pair of protruding portions is abutted is positioned above the engaging portion in the entering direction of the pair of protruding portions.

* * * * *